US006227920B1

(12) United States Patent
Alby et al.

(10) Patent No.: US 6,227,920 B1
(45) Date of Patent: May 8, 2001

(54) FASTENER FOR ATTACHING AN OUTBOARD MOTOR TO A TRANSOM OF A BOAT

(75) Inventors: Jeremy L. Alby, Oshkosh; Martin E. Olson Gunderson, Green Bay; Darin C. Uppgard, Neshkoro, all of WI (US)

(73) Assignee: Brunswick Corporation, Lake Forest, IL (US)

( * ) Notice: Subject to any disclaimer, the term of this patent is extended or adjusted under 35 U.S.C. 154(b) by 0 days.

(21) Appl. No.: 09/385,729

(22) Filed: Aug. 30, 1999

(51) Int. Cl.[7] ..... B63H 5/20; B63H 5/125; B63H 20/08

(52) U.S. Cl. ..... 440/53

(58) Field of Search ..... 248/640, 641, 248/642, 643, 217.1, 217.4, 220.43, 221.11, 295.11, 296.1, 297.11, 297.21, 297.31, 297.51; 411/148, 154, 511, 531, 534, 546, 84, 85; 440/53

(56) References Cited

U.S. PATENT DOCUMENTS

| | | | | |
|---|---|---|---|---|
| D. 026,563 | * | 1/1897 | Heiser | D8/399 |
| 426,341 | * | 4/1890 | Strong | 269/70 |
| 1,586,642 | * | 6/1926 | Arndt | 248/226.12 |
| 1,705,488 | * | 3/1929 | Mathews | 248/297.21 |
| 1,930,314 | * | 10/1933 | Healy et al. | 248/74.4 |
| 2,163,446 | * | 6/1939 | Heckman | 52/709 |
| 3,008,368 | * | 11/1961 | Hammitt et al. | 411/368 |
| 3,911,853 | | 10/1975 | Strang . | |
| 4,239,172 | * | 12/1980 | Spitzmesser | 248/641 |
| 4,354,847 | | 10/1982 | Blanchard . | |
| 4,355,986 | | 10/1982 | Stevens . | |
| 4,363,629 | | 12/1982 | Hall et al. . | |
| 4,384,856 | | 5/1983 | Hall et al. . | |
| 4,395,238 | | 7/1983 | Payne . | |
| 4,406,634 | | 9/1983 | Blanchard . | |
| 4,449,945 | | 5/1984 | Ferguson . | |
| 4,450,635 | * | 5/1984 | Shwayder | 37/271 |
| 4,545,770 | | 10/1985 | Ferguson . | |
| 4,687,165 | * | 8/1987 | Blackburn | 248/274.1 |
| 5,154,651 | | 10/1992 | Binversie et al. . | |
| 5,222,851 | * | 6/1993 | Dickerson | 411/397 |
| 5,359,824 | * | 11/1994 | Koberstein | 52/507 |

* cited by examiner

*Primary Examiner*—S. Joseph Morano
*Assistant Examiner*—Andrew Wright
(74) *Attorney, Agent, or Firm*—William D. Lanyi

(57) ABSTRACT

The fastener for attaching a first component to a second component comprises an elongated opening formed in the first component with, the elongated opening having a plurality of similarly shaped portions. An insert is disposable into each one of the plurality of similarly shaped portions, which can be square in a preferred embodiment, and each of the plurality of the similarly shaped portions of the elongated opening is shaped to receive the insert therein. The insert is limited in movement by the elongated opening to a direction that is perpendicular to the plane of the elongated opening. A hole is formed in the second component and a cylindrical member is disposable through the insert, through the hole, and through the elongated opening. A capture mechanism prevents the insert from moving out of the elongated opening in a direction perpendicular to the plane of the elongated opening.

9 Claims, 13 Drawing Sheets

FASTENER FOR ATTACHING AN OUTBOARD MOTOR TO A TRANSOM OF A BOAT

BACKGROUND OF THE INVENTION

1. Field of the Invention

The present invention is generally related to outboard motors and, more particularly, to specific mounting configurations of an outboard motor to a transom of a boat, including the arrangement of a motor and hydraulic pump relative to the steering components of the outboard motor and further including a secure means for fastening the outboard motor to the transom of a boat.

2. Description of the Prior Art

Many different types of outboard motors are well known to those skilled in the art. Numerous techniques have been developed for mounting an outboard motor to a transom of a boat, including many different types of steering and tilting arrangements.

U.S. Pat. No. 3,911,853, which issued to Strang on Oct. 14, 1975, describes a low profile outboard motor with an in-line engine. The outboard motor comprises a propulsion unit that is adapted to be attached to the transom of a boat for vertical swinging movement relative to the transom about a horizontal tilt axis and for steering movement relative to the transom about a steering axis extending transversely of the tilt axis. The propulsion unit comprises a lower unit including an exhaust gas discharge outlet normally located under water, a power head assembly rigidly fixed to the top of the lower unit and including an engine with a plurality of vertical in-line cylinders each including an exhaust port, together with an exhaust gas discharge system including an inverted "U" shaped passageway comprising an upper junction portion located above the at rest water level when the outboard motor is boat mounted, a first leg extending downwardly from the junction portion and communicating with at least one of the exhaust ports, and a second leg extending downwardly from the junction portion and separately from the first leg and communicating with the lower unit underwater exhaust gas discharge outlet. Also included in the outboard motor is an upwardly open water guard which extends upwardly from above the lower unit, in watertight encircling relation to the engine, to above the at rest water level.

U.S. Pat. No. 4,354,847, which issued to Blanchard on Oct. 19, 1982, describes a high tilt pivot mounting arrangement for an outboard motor. The marine propulsion device comprises a transom bracket adapted to be fixed to a boat transom, a swivel including a vertical leg having upper and lower ends, and a pair of arms extending upwardly in laterally spaced relation from the upper end of the swivel bracket vertical leg and including respective upper ends, a first pivot connecting the upper ends of the arms and the transom bracket for vertical swinging of the swivel bracket relative to the transom bracket about a first axis which is horizontal when the transom bracket is boat mounted, a propulsion unit including a power head and lower unit fixedly connected to the power head and including, at the lower end thereof, a propeller, and a second pivot connecting the propulsion unit and the swivel bracket vertical leg for movement of the propulsion unit in common with the swivel bracket about the first axis and for steering movement of the propulsion unit relative to the swivel bracket about an axis which extend transversely to the first axis.

U.S. Pat. No. 4,355,986, which issued to Stevens on Oct. 26, 1982, describes an outboard motor with elevated horizontal pivot axis. The outboard comprises a transom bracket adapted to be fixed to a boat transom and having a generally flat mounting surface for engagement with the back of the transom, a swivel bracket, a pivot on the swivel bracket and on the transom bracket rearwardly of the mounting surface for pivotally connecting the swivel bracket and the transom bracket for tilting movement between a normal operating position and a raised tilt position and about a tilt axis which is generally horizontal when the transom bracket is fixed to the boat transom, a propulsion unit including a power head and a lower unit rigidly secured to the power head, and a pivot connected to the propulsion unit and located below the power head and connected to the swivel bracket for pivotally connecting the propulsion unit and the swivel bracket for steering movement about an axis transverse to the tilt axis and such that the propulsion unit remains rearwardly of the plane of the transom bracket mounting surface throughout movement of the swivel bracket from the normal operating position to the tilt position.

U.S. Pat. No. 4,363,629 which issued to Hall et al on Dec. 14, 1982, describes a hydraulic system for outboard motors with sequentially operating tilt and trim means. The marine propulsion device comprises a transom bracket adapted to be connected to a boat transom, a first pivot connecting a stem bracket to the transom bracket for pivotal movement of the stem bracket relative to the transom bracket about a first pivot axis which is horizontal when the transom bracket is boat mounted, a second pivot connecting a swivel bracket to the stem bracket below the first pivot for pivotal movement of the swivel bracket with the stem bracket and relative to the stem bracket about a second pivot axis parallel to the first pivot axis, a king pin pivotally connecting a propulsion unit including a rotatably mounted propeller to the swivel bracket for steering movement of the propulsion unit relative to the swivel bracket about a generally vertical axis and for common pivotal movement with the swivel bracket in a vertical plane about the first and second horizontal axes, a trim cylinder piston assembly pivotally connected to the stem bracket and to the swivel bracket, a tilt cylinder-piston assembly pivotally connected to the transom bracket and to the stem bracket, and a fluid conduit system communicating between a source of pressure fluid and each of the tilt cylinder-piston assembly and the trim cylinder-piston assembly and including apparatus operable, during reverse operation of the propulsion unit, for causing initial full extension to the trim cylinder-piston assembly, followed by extension of the tilt cylinder-piston assembly, and for causing initial full contraction of the tilt cylinder-piston assembly, followed by subsequent contraction of the trim cylinder piston assembly.

U.S. Pat. No. 4,384,856, which issued to Hall et al on May 24, 1983, describes a lateral support arrangement for outboard motors with separate tilt and trim axes. The outboard motor comprises a transom bracket adapted to be connected to a boat transom, a propulsion unit which is mounted to the transom bracket for pivotal steering movement of the propulsion unit in a horizontal plane and for pivotal movement of the propulsion unit in the vertical plane between a lowermost running position and a full tilt position, which propulsion unit mounting includes a first pivot connecting an intermediate bracket to the transom bracket for pivotal movement of the intermediate bracket relative to the transom bracket about a first pivot axis which is horizontal when the transom bracket is boat mounted, whereby to enable movement of the propulsion unit through a tilt range, a second pivot connecting a swivel bracket to the intermediate bracket for pivotal movement of the swivel bracket with the intermediate bracket and relative to the intermediate bracket about a second pivot axis parallel to the first pivot axis, whereby to enable movement of the propulsion unit through a trim range, and a king pin pivotally connecting the propulsion unit to the swivel bracket for steering movement of the propulsion unit relative to the swivel bracket about a generally vertical axis and for common pivotal movement of the swivel bracket in a vertical plane above the first and second horizontal axes, hydraulic cylinders for sequentially displacing the propulsion unit from the lowermost position through the trim range and then through the tilt range to the full tilt position, and a support on the transom bracket for providing side support to the intermediate bracket.

U.S. Pat. No. 4,395,238, which issued to Payne on Jul. 26, 1983, describes an outboard motor mounting means which affords upward tilting without travel of the motor forward of the boat transom. The marine propulsion device comprises a bracket adapted to be fixed to the transom of a boat and including a generally planar mounting surface engaged with the boat transom when the boat is boat mounted, which bracket also includes a lower part having a lower bearing with a steering axis which extends generally vertical when the bracket is boat mounted, a member including a lower portion extending in the lower bearing and a pair of laterally spaced arms connected to the lower portion and respectively including upper horizontal bearings having a common axis located in spaced relation above the lower bearing, a steering arm fixed to the member for steerably rotating the member within the lower bearing about the generally vertical axis, a propulsion unit including a power head and a lower unit extending fixedly downward from the power head and including a rotatably mounted propeller, and trunnions on the power head adjacent the top thereof and received in the upper horizontal bearings for pivotally connecting the propulsion unit to the member for movement about the horizontal axis between a running position with the propeller submerged in water and with the propulsion unit located wholly aft of the bracket mounting surface and an elevated position with the propeller substantially out of the water and with the propulsion unit located wholly aft of the bracket mounting surface.

U.S. Pat. No. 4,406,634, which issued to Blanchard on Sep. 27, 1983, describes an outboard motor with steering arm located aft of the transom and below the tilt axis. The outboard motor comprises a transom bracket adapted to be fixed to the transom of a boat, a propulsion unit supporting a thrust producing element, and a bracket assembly connecting the propulsion unit to the transom bracket so as to provide for pivotal steering movement of the propulsion unit relative to the transom bracket and for tilting of the propulsion unit relative to the transom bracket about a tilt axis located rearwardly of the transom, which bracket assembly connecting the propulsion unit to the transom bracket includes a steering arm connected to the propulsion unit and extending forwardly therefrom below the tilt axis and having a forward end terminating rearwardly of the transom.

U.S. Pat. No. 4,449,945, which issued to Ferguson on May 22, 1984, describes an outboard motor mounting arrangement. The marine propulsion installation comprises a marine propulsion device including a transom bracket having a mounting portion fixed to the rear of the boat transom below the upper edge thereof, and a pair of laterally spaced arms extending upwardly from the mounting portion and including respective upper ends located rearwardly of the boat transom and above the upper edge thereof, a swivel bracket comprising a mounting portion and a pair of laterally spaced arms extending upwardly from the swivel bracket mounting portion and including respective upper ends, a tilt pin connecting the upper ends of the transom bracket and swivel bracket arms to provide the pivotal movement of the swivel bracket relative to the transom bracket about a tilt axis which is horizontally located rearwardly of the transom and above the upper edge thereof, a propulsion unit including an internal combustion engine and a propeller mounted for rotation and driven by the engine, and a king pin connecting the propulsion unit to the swivel bracket mounting portion for pivotal steering movement of the propulsion unit relative to the swivel bracket about a second axis transverse to the tilt axis and for common movement of the propulsion unit with the swivel bracket about the tilt axis and without travel of the propulsion unit over the transom upper edge or into engagement with the transom.

U.S. Pat. No. 4,545,770, which issued to Ferguson on Oct. 8, 1985, describes an outboard motor mounting arrangement. The marine propulsion installation comprises a marine propulsion device including a transom bracket having a mounting portion fixed to the rear of the boat transom below the upper edge thereof, and a pair of laterally spaced arms extending upwardly from the mounting portion and including respective upper ends located rearwardly of the boat transom and above the upper edge thereof, a swivel bracket comprising a mounting portion and a pair of laterally spaced arms extending upwardly from the swivel bracket mounting portion and including respective upper ends, a tilt pin connecting the upper ends of the transom bracket and swivel bracket arms to provide the pivotal movement of the swivel bracket relative to the transom bracket about a tilt axis which is horizontally located rearwardly of the transom and above the upper edge thereof, a propulsion unit including an internal combustion engine and a propeller mounted for rotation and driven by the engine, and a king pin connecting the propulsion unit to the swivel bracket mounting portion for pivotal steering movement of the propulsion unit relative to the swivel bracket about a second axis transverse to the tilt axis and for common movement of the propulsion unit within the swivel bracket about the tilt axis and without travel of the propulsion unit over the transom upper edge or into engagement with the transom.

U.S. Pat. No. 5,154,651, which issued to Binversie et al on Oct. 13, 1992, describes a marine propulsion device tilt tube. An outboard motor comprises a transom bracket which is adapted to be mounted on the transom of a boat and which includes first and second generally horizontally spaced apart portions, a tilt tube which extends through the transom bracket portions and along a generally horizontal tilt axis and which includes a first end portion extending outwardly of the first transom portion and a second end portion extending outwardly of the second transom bracket portion, a swivel bracket mounted on the tilt tube for pivotal movement relative to the transom bracket above the tilt axis, a propulsion unit mounted on the swivel bracket for common movement therewith about the tilt axis and for pivotal movement relative thereto about a generally vertical steering axis, the propulsion unit including a propeller shaft adapted to support a propeller, and a steering arm adapted to be mounted to a remote steering system, and structure on both of the tilt tube end portions for permitting the remote steering system to be alternatively connected to the first end portion or to the second end portion.

Known outboard motor mounting arrangements exhibit several disadvantages. First, most known outboard motor mounting arrangements cause the steering axis to be tilted when the outboard motor is trimmed or tilted. In other words, the steering axis moves with the outboard motor relative to the transom when the outboard motor is trimmed or tilted. In addition, known mounting configurations for outboard motors typically leave hydraulic pumps and electric motors exposed within their structure and also require valuable space for mounting the hydraulic pump and its related electric motor. In addition, most outboard motors are attached to a transom of the boat in a way that results in disadvantageous force vectors and torques being imposed on the components of the outboard motor and mounting structure. It would therefore be beneficial if an outboard motor mounting structure arrangement could be provided which does not require the steering axis to be tilted when the outboard motor is trimmed or tilted. It would be further beneficial if a means could be provided which allowed the hydraulic pump and associated electric motor to be housed within components of the steering and tilting system to avoid the necessity of using valuable space for these components. In addition, it would be beneficial if a simple, but secure, fastening system could be providing for mounting the outboard motor to the transom of a boat.

SUMMARY OF THE INVENTION

The present invention is generally related to an improved mounting arrangement for an outboard motor. It includes improvements in the configuration of the tilting and steering components, the advantageous placement of the hydraulic pump and electric motor within certain components of the steering and tilting system, and a simplified means for attaching the outboard motor to the transom of a boat.

An outboard motor made in accordance with one embodiment of the present invention comprises a pedestal which is attachable to a transom of a boat. It also comprises a motor support platform that is attached to the outboard motor and a steering mechanism that is attached to both the pedestal and the motor support platform. A tilting mechanism is attached to the motor support platform and to the outboard motor, the outboard motor being rotatable about a tilt axis relative to both the pedestal and the motor support platform. The tilting mechanism is rotatable relative to the pedestal and about a steering axis. The steering axis is generally vertical and stationary relative to the pedestal. The tilting mechanism is rotatable relative to the pedestal and about the steering axis with the outboard motor. When an outboard motor is tilted about its tilt axis, the steering axis does not move from its generally vertical position which is stationary relative to the transom of the boat.

One embodiment of the present invention provides an outboard motor that comprises a pedestal which is attachable to the transom of a boat, a motor support platform attached to the outboard motor, and a steering mechanism attached to both the pedestal and the motor support platform. A hydraulic tilting mechanism is attached to the motor support platform and to the outboard motor. The outboard motor is rotatable about a tilt axis relative to both the pedestal and the motor support platform. The tilting mechanism is rotatable relative to the pedestal and about a steering axis which is generally vertical and stationary relative to the pedestal. The tilting mechanism is rotatable relative to the pedestal and about a steering axis with the outboard motor. A hydraulic pump is connected in fluid communication with the hydraulic tilting mechanism and provides pressurized fluid to cause the outboard motor to rotate about the tilting axis. An electric motor is connected in torque transmitting relation with the hydraulic pump and both the electric motor and the hydraulic pump are disposed within the steering mechanism.

The attachment of an outboard motor to the transom of a boat is facilitated by an embodiment of the present invention which provides a fastener for attaching a first component to a second component. A preferred embodiment of the fastener comprises an elongated opening formed in the first component, with the elongated opening having a plurality of similarly shaped portions. An insert is disposable into each one of the plurality of similarly shaped portions. Each of the plurality of similarly shaped portions of the elongated opening is shaped to receive the insert therein. The insert is limited in movement by the elongated opening to a direction perpendicular to the plane of the elongated opening. A hole is formed in the second component and a cylindrical member is disposable through the insert, through the hole, and through the elongated opening. A capture mechanism prevents the insert from moving out of the elongated opening in the direction perpendicular to the plane of the elongated opening.

BRIEF DESCRIPTION OF THE DRAWINGS

The present invention will be more fully and completely understood from a reading of the description of the preferred embodiment in conjunction with the drawings, in which.

DESCRIPTION OF THE PREFERRED EMBODIMENT

Figure 1:
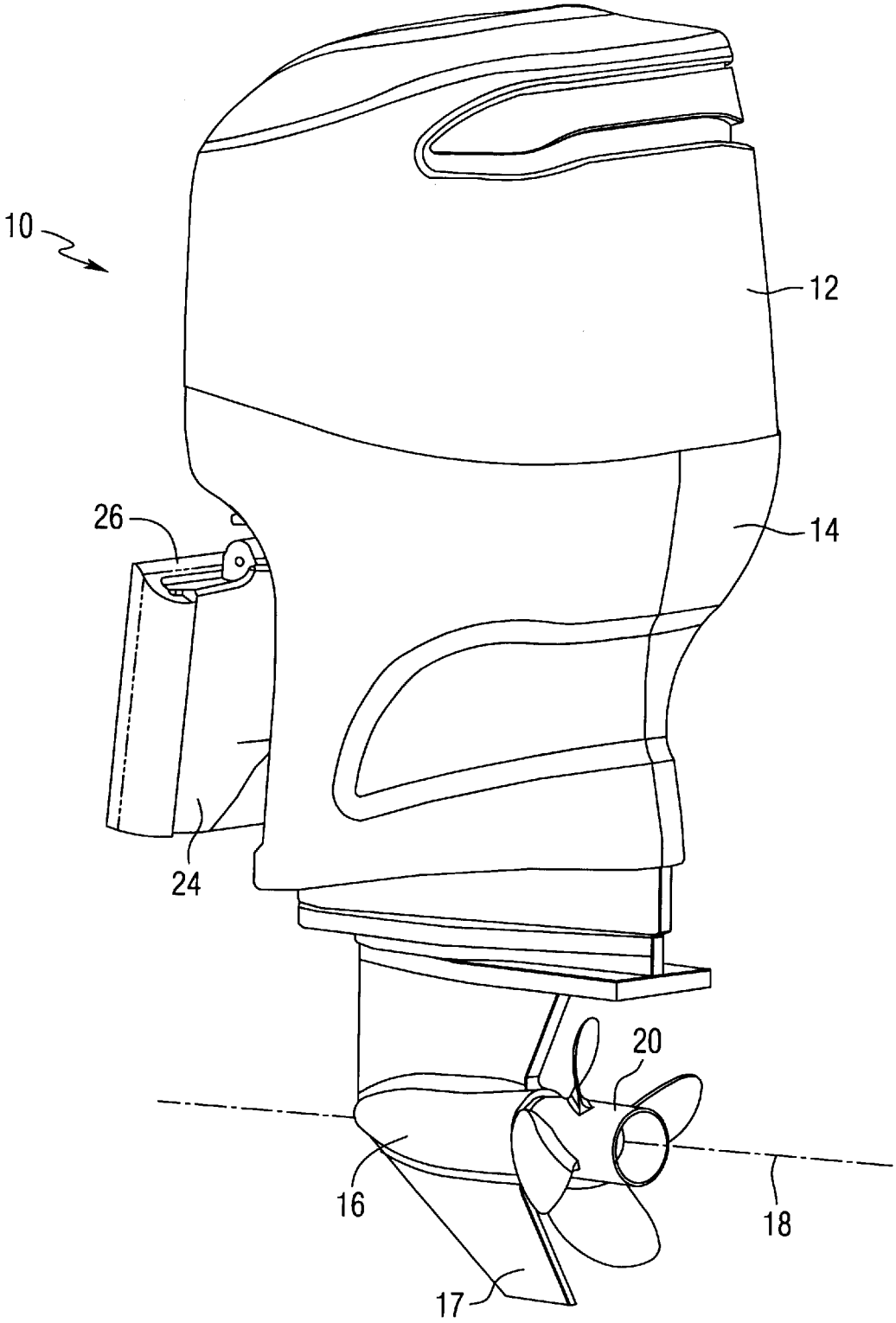
FIG. 1 shows an outboard motor made in accordance with the present invention.

Throughout the description of the preferred embodiment of the present invention, like components will be identified by like reference numerals.

FIG. 1 shows an outboard motor 10 having a cowl 12 and a lower cowl 14. An internal combustion engine (not shown in FIG. 1) is located under the cowl 12 and a driveshaft extends downward from the internal combustion engine within the lower cowl 14, and in torque transmitting relation with a propeller shaft that is contained within the lower gear housing 16 to rotate about axis 18. This causes the propeller 20 to rotate about axis 18 to provide propulsion for a boat. Attached to the outboard motor 10 is a pedestal 24. In certain embodiments of the present invention, the pedestal 24 is shaped to be received within a track of an intermediate plate 26. As will be described in greater detail below, the pedestal 24 can be moved up or down relative to the intermediate plate 26 to select an appropriate operating position for the outboard motor 10. The pedestal 10 is then rigidly fastened to the intermediate plate 26 during operation of the outboard motor 10. It should be understood that not all embodiments of the present invention require the intermediate plate 26. Instead, the pedestal 24 can be fastened directly to a transom of a boat. When the intermediate plate 26 is used, it is fastened directly to the transom of a boat and the pedestal 24 is attached to the intermediate plate 26.

Figure 2:
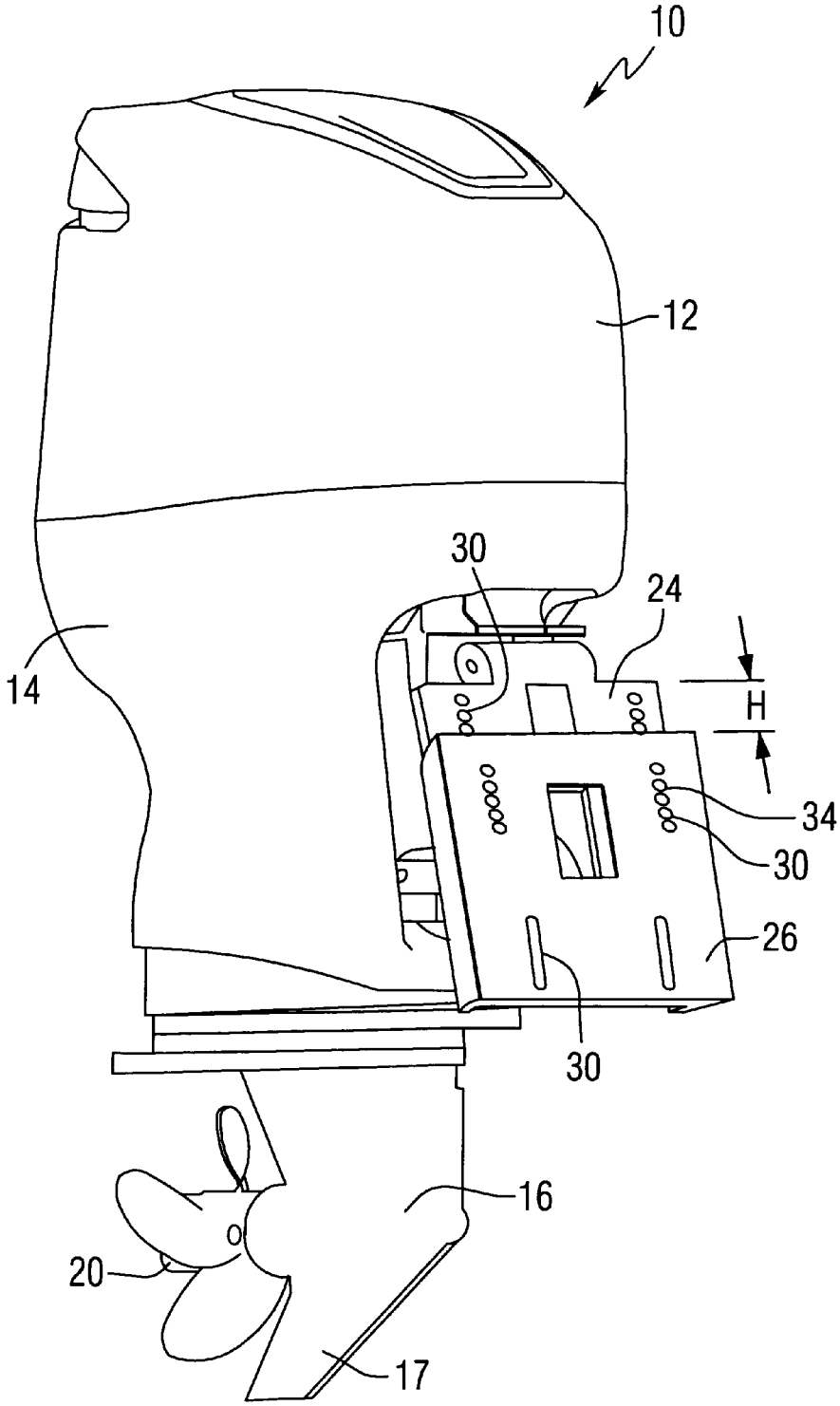
FIG. 2 is a reverse view of the illustration shown in FIG. 1.

FIG. 2 shows the outboard motor 10 of FIG. 1, but from an opposite direction. As illustrated in FIG. 2, the pedestal 24 is slidable relative to the intermediate plate 26. In one embodiment of the present invention that will be described in greater detail below in conjunction with FIGS. 15 and 16, a hydraulic cylinder is attached to both the pedestal 24 and intermediate plate 26 to automatically force the pedestal 24 linearly relative to the intermediate plate 26. This has the effect of automatically raising or lowering the outboard motor 10 relative to the transom of the boat.

With continued reference to FIGS. 1 and 2, the propeller 20 rotates about its rotational axis 18 and is protected during operation by the skeg 17. Both the pedestal 24 and the intermediate plate 26 are provided with a plurality of elongated openings 30 which facilitate the attachment of the intermediate plate 26 to a transom of a boat or the pedestal 24 to a transom of a boat. When both the pedestal 24 and intermediate plate 26 are used, as in certain embodiments of the present invention, only the intermediate plate 26 is attached to the transom. The precise shapes of the elongated openings 30 and their plurality of similarly shaped portions 34 will be described in much greater detail below. In FIG. 2, dimension H is provided to illustrate that the pedestal 24 can be raised relative to the intermediate plate 26 by a hydraulic mechanism (not shown in FIG. 2).

Figure 3:
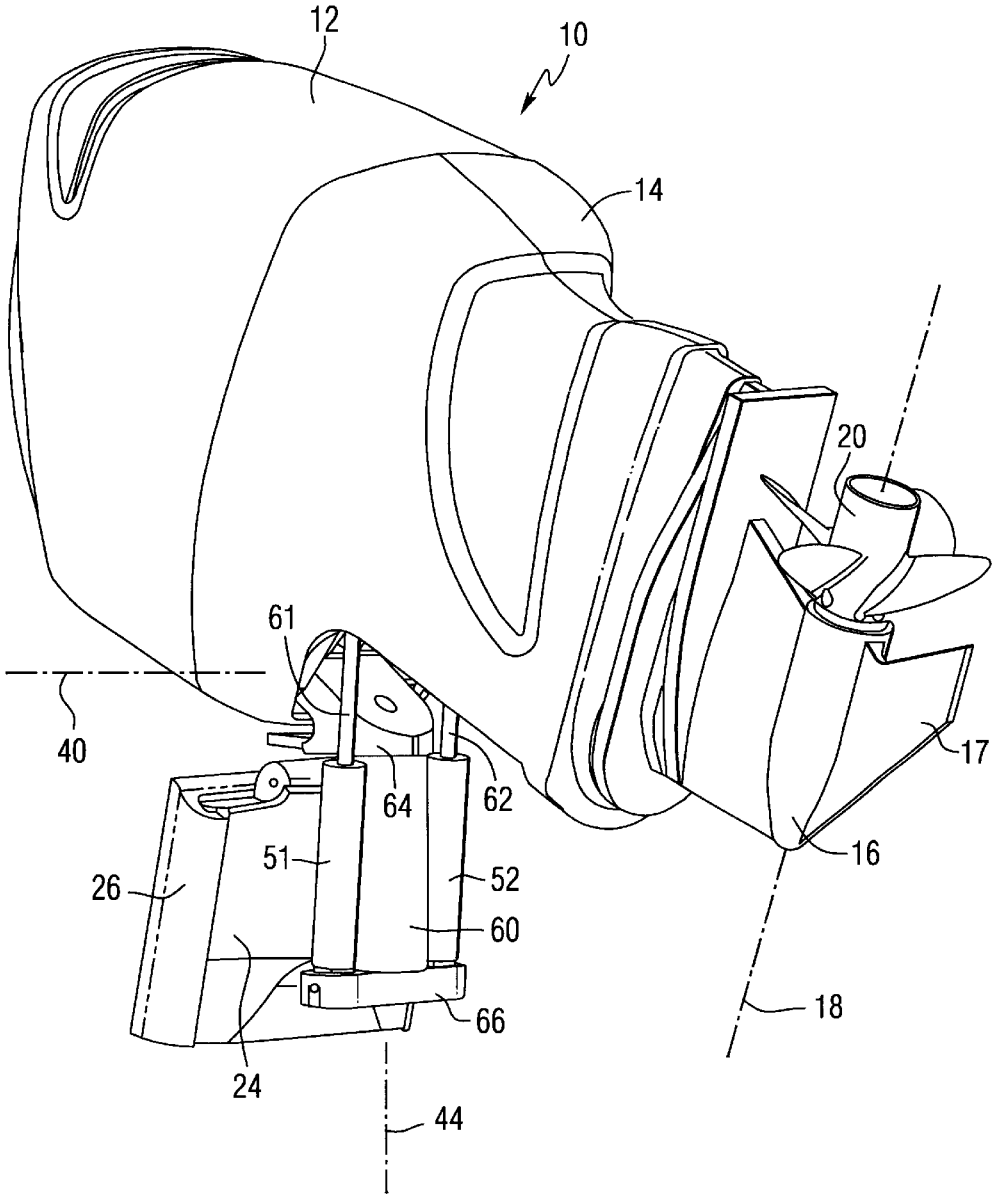
FIG. 3 shows the present invention in conjunction with an outboard motor that is tilted upward from its normal operating position.

FIG. 3 shows the outboard motor 10 tilted about its tilting axis 40. One of the most significant benefits of the present invention is illustrated in FIG. 3. It can be seen that the steering axis 44 remains generally vertical and stationary relative to the transom of a boat to which the intermediate plate 26 or the pedestal 24 is attached. Even though the outboard motor 10 is tilted about its tilting axis 40, the steering axis 44 remains stationary and generally vertical.

With continued reference to FIG. 3, the tilting mechanism of the present invention comprises a first cylinder 51 and a second cylinder 52. Pistons are located in each of the two cylinders and a first rod 61 is connected to the piston in the first cylinder 51 and a second rod 62 is connected to the second piston within the second cylinder 52. A pedestal tube 60 is rigidly attached to the pedestal 24. A steering head 64 is attached to a swivel tube (not shown in FIG. 3) which extends downward through the internal portion of the pedestal tube 60 and is attached to the lower yoke 66. As can be seen in FIG. 3 the cylinders, 51 and 52, are connected to the lower yoke 66. The ends of their respective rods, 61 and 62, are attached to the outboard motor 10 so that the cylinders can exert an upward force that causes the outboard motor 10 to tilt about its tilting axis 40. The lower yoke 66 forms an important part of the motor support platform of the present invention.

With continued reference to FIG. 3, it should be understood that when the outboard motor 10 is rotated about its steering axis 44, the motor support platform rotates with the outboard motor 10. In other words, the lower yoke 66, the steering head 64, and both cylinders, 51 and 52, rotate in unison about the steering axis 44 and relative to the pedestal tube 60. When a boat operator moves the steering control of the boat, the outboard motor 10 rotates about the steering axis 44 in unison with the lower yoke 66, the steering head 64, the cylinders, 51 and 52, and the swivel tube (not shown in FIG. 3) that extends downward within the pedestal tube 60 between the steering head 64 and the lower yoke 66. This characteristic is significantly different than outboard motor structures known to those skilled in the art. As will be described in greater detail below, known outboard motors cause the steering axis 44 to move when the outboard motor is tilted about its tilting axis 40. The arrangement generally known to those skilled in the art can have serious deleterious effects that will be described in greater detail below.

Figure 4:
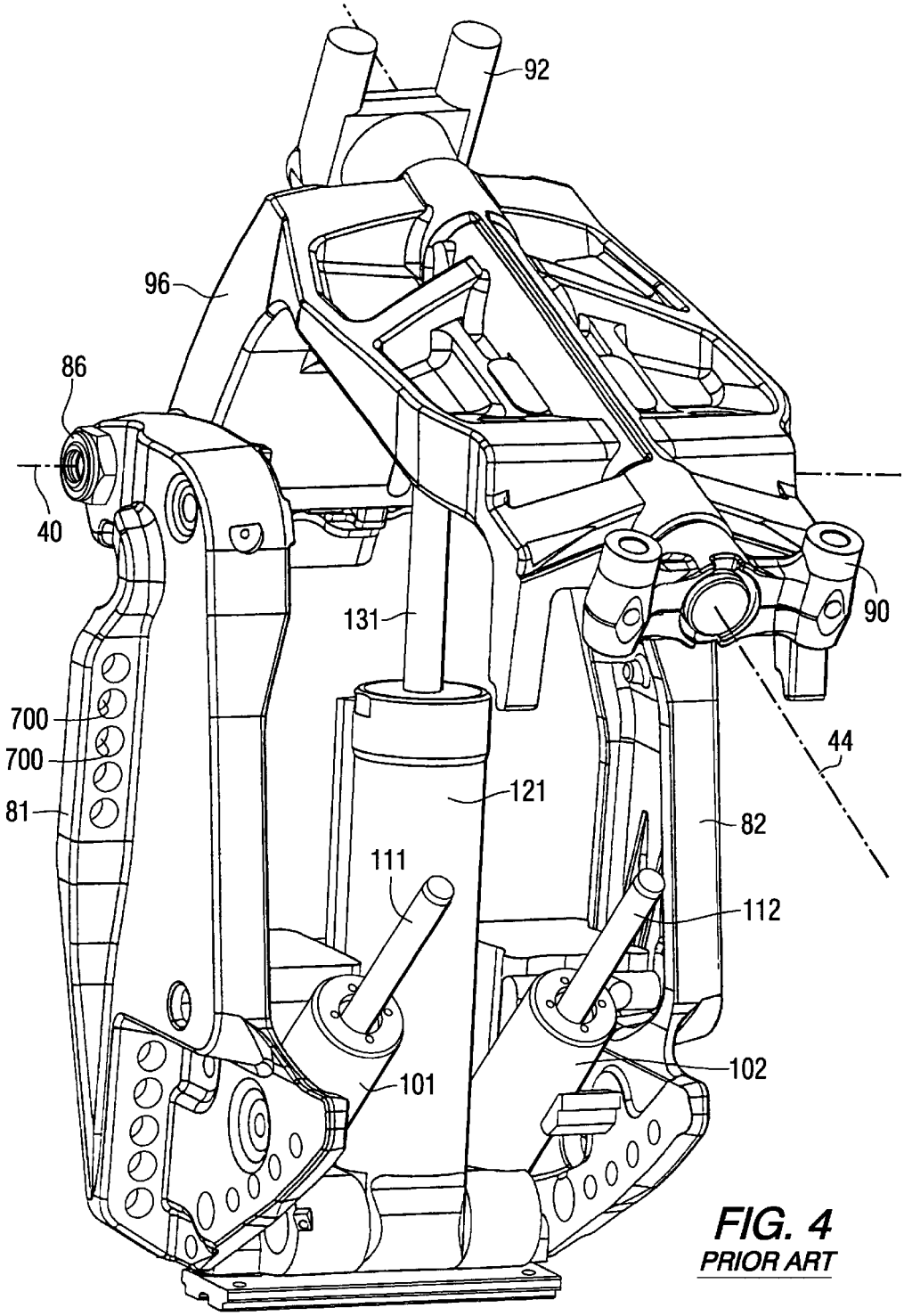
FIG. 4 PRIOR ART
FIG. 4 shows a prior art transom bracket, steering mechanism, and tilt mechanism.

FIG. 4 shows the prior art outboard motor support structure. For purposes of clarity, an outboard motor is not illustrated in FIG. 4. First and second clamp brackets, 81 and 82, are individual components that are connected together by a tilt tube 86 that extends horizontally. The tilt tube 86 defines the tilting axis 40 and outboard motor support structures known in the prior art. A lower yoke assembly 90 and an upper yoke assembly 92 provide the supporting attachment to an outboard motor. A swivel bracket 96 rotates about the tilting axis 40 under the control of hydraulic cylinders, 101 and 102, which are associated with rods, 111 and 112, respectively. As is generally known to those skilled in the art, each of the rods, 111 and 112 is attached to a piston that is disposed within the cylinders, 101 and 102, respectfully. In certain outboard motors, an additional cylinder 121 is provided to further tilt the outboard motor in an upward direction about the tilting axis 40. The rod 131, is attached to the swivel bracket 96 for these purposes.

With continued reference to the prior art structure shown in FIG. 4, it can be seen that when the outboard motor is tilted about the tilting axis 40, the steering axis 44 moves from a generally vertical position to a tilted position. As a result, the steering effect generated by an operator of a watercraft always causes the outboard motor to rotate about a steering axis 44 that is located relative to the boat as a function of the position of the swivel bracket 96 relative to the tilting axis 40.

By comparing FIGS. 3 and 4, it can be seen that the present invention does not move the steering axis 44 when the outboard motor 10 is tilted about the tilting axis 40. However, the prior art device shown in FIG. 4 changes the position of the steering axis 44 relative to the transom of a boat when the swivel bracket 96 is rotated about the tilting axis 40.

Figures 5A, 5B:
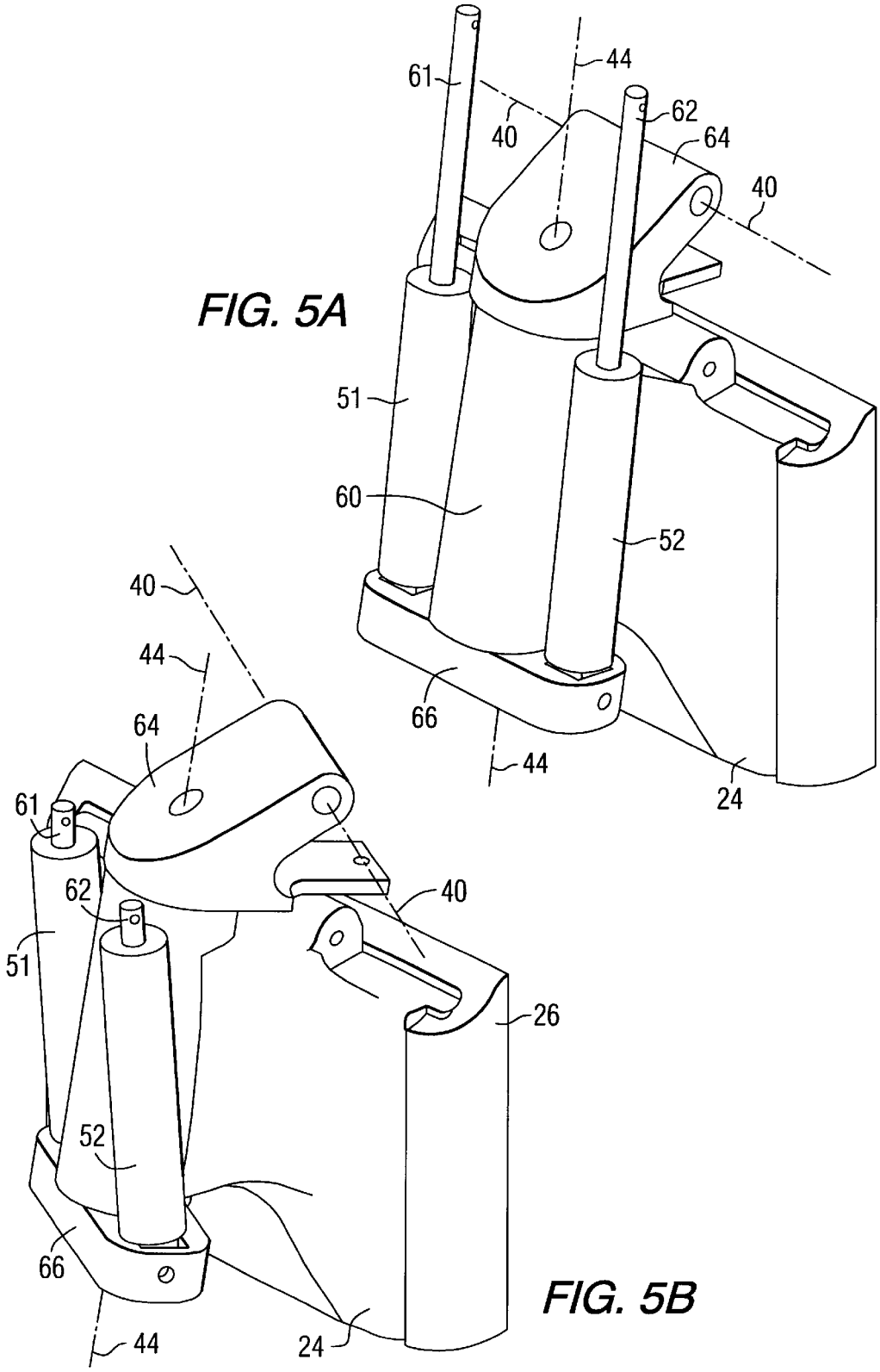
FIGS. 5A and 5B show isolated views of portions of the present invention in two steering and positions.

FIGS. 5A and 5B show the pedestal 24 and intermediate plate 26 without an outboard motor attached. In FIG. 5A, the steering head 64 and the lower yoke 66 of the motor support platform are aligned in a central position. This is the position that the motor support platform would be in when a boat is moving in a straight ahead direction. As described above in conjunction with FIG. 3, the pedestal tube 60 is rigidly attached to the pedestal 24 and does not rotate relative to the pedestal 24 under any condition. The steering head 64 and lower yoke 66 are attached to a swivel tube (not shown in FIGS. 5A or 5B) which is disposed within the pedestal tube 60 and which is rotatable about the steering axis 44 in unison with the steering head 64 and the lower yoke 66.

FIG. 5B is similar to FIG. 5A, except that the steering head 64 and lower yoke 66 are rotated relative to the pedestal 24 and intermediate plate 26. Also, it can be seen that cylinders, 51 and 52, and the rods, 61 and 62, rotate in unison with the steering head 64 and lower yoke 66 and also rotate relative to the pedestal 24. This rotation of the steering head 64, lower yoke 66, cylinders, 51 and 52 and rods, 61 and 62, is about the steering axis 44. It can be seen that this rotation also causes the tilting axis 40 to rotate relative to the pedestal 24 and about the steering axis 44. This relationship between the steering axis 44 and the tilting axis 40, when the outboard motor is rotated about its steering axis, is significantly different than the known relationship between these two axes in the prior art. As described above, the prior art steering axis 44 is moved relative to the transom of the boat when the outboard motor is tilted about its tilting axis 40. As illustrated in FIGS. 5A and 5B, the opposite is true in an outboard motor made in accordance with the present invention.

The arrangement of the components of the present invention and the way in which those components interact provide several significant advantages when compared to the operation of known outboard motor support structures. These advantages will be described below.

Figure 6A:
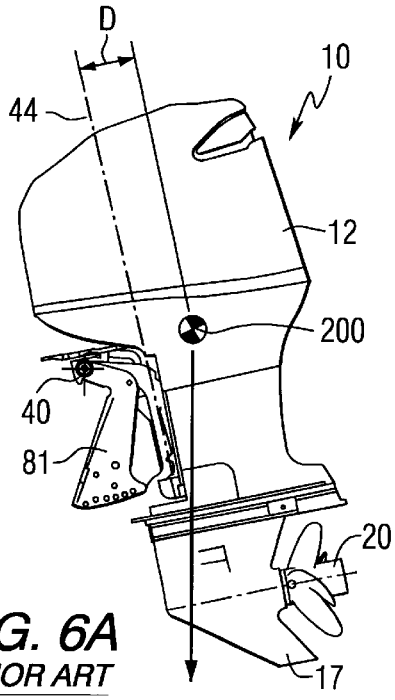
FIG. 6A PRIOR ART
FIGS. 6A and 6B compare the prior art to the present invention with regard to steering stability in relation to the center of gravity of the overall structure.

FIG. 6A shows a known arrangement of an outboard motor shown with a slight degree of trim that is achieved by rotating the swivel bracket 96, as described above in conjunction with FIG. 4, about the tilting axis 40. Since the steering axis 44 is rotated with the swivel bracket 96, the center of gravity 200 can intersect the steering axis 44. As a result, when an operator causes the outboard motor 10 to rotate about its steering axis 44, the center of gravity 200 can move from the port side of the center of gravity 200 to the starboard side, or vice versa. The effect of this arrangement is that the weight of the outboard motor 10 provides an additional force in the direction of the turn. In other words, if an operator moves from a straight ahead condition to a starboard turn, the weight of the outboard motor acting through the center of gravity 200 will cause the outboard motor 10 to oversteer in a starboard direction. As the operator turns back to a port direction, the center of gravity 200 of the outboard motor 10 will move past its center position where it intersects the steering axis 44 and then begin to exert a force which can cause oversteering in the port direction. This effect varies with the degree of trim or tilt.

Figure 6B:
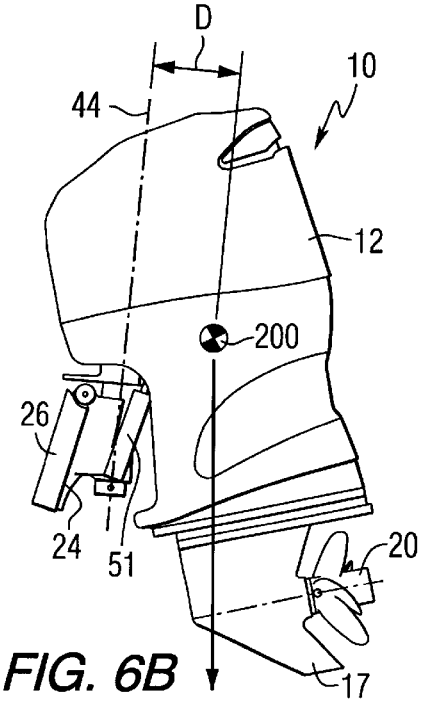

FIG. 6B shows the present invention under the same conditions of trim. As can be seen, the center of gravity 200 remains behind the steering axis 44 under all conditions. As a result, the force exerted by the center of gravity 200 is constant under all conditions. Whatever slight force might be exerted by the outboard motor 10 through its center of gravity 200, during a steering operation, has the effect of causing a slight understeering. In other words, the force exerted through the center of gravity 200 will be in the direction toward a neutral steering position. However, by comparing FIGS. 6A and 6B, it can be seen that the overall effect of the present invention is to provide additional stability and to reduce the effect of the weight of the outboard motor 10 on the steering process. It can also be seen that the distance D between the center of gravity 200 and the steering axis 44 is much greater in the present invention than in the prior art. This maintains the position of the center of gravity 200 behind the steering axis 44 and in a non-intersecting association with the steering axis 44. Unlike the force vector extending downward from the center of gravity 200 in FIG. 6A, the force vector extending downward from the center of gravity 200 in FIG. 6B does not intersect the steering axis 44 under any operating condition.

Figure 7A:
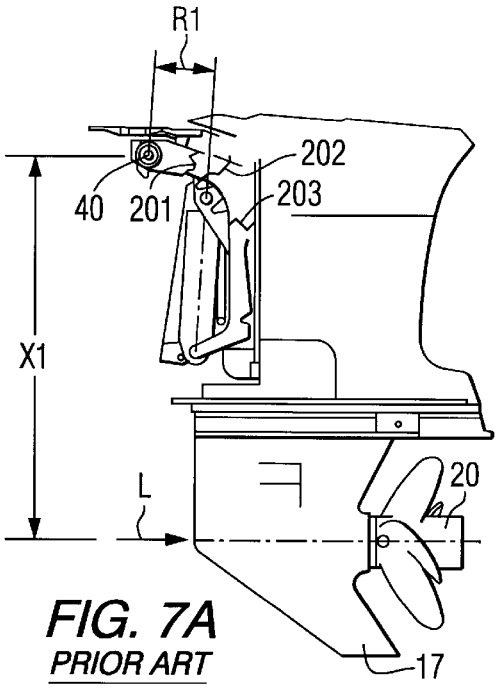
FIG. 7A PRIOR ART
FIGS. 7A and 7B compare the prior art to the present invention with regard to certain log strike conditions.
Figure 7B:
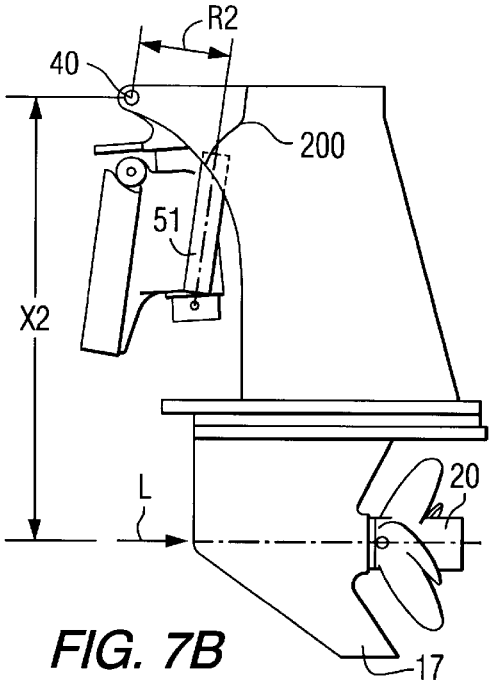

When in operation, it is possible that the lower portion of an outboard motor may strike a floating or slightly submerged object, such as a log. With reference to FIGS. 7A and 7B, a log strike will cause a force L to be imposed against the lower portion of the outboard motor. In FIGS. 7A and 7B, it can be seen that the moment arm X2 between the tilting axis 40 and the log strike force L is greater than the moment arm X1 in the prior art. This is primarily due to the selection of the location of the tilting axis 40 and could possible change for different styles of outboard motors. However, it should be noted that the reaction moment arm R2 between the reacting cylinder 51 and the tilting axis 40 is larger than the reacting moment arm R1 in the prior art. This provides a significant advantage because it allows the structure of the present invention to react to the log strike force L and at a region of greater dimension. Line 200 represents the location where the present invention would fail if a failure occurs. Lines 201, 202, and 203 represent hypothetical locations where the brackets known in the prior art would fail under more extreme circumstances. Because dimension R2 is greater than dimension R1, the present invention is able to react to the log strike force L with a much more substantial portion of the structure than is possible in the prior art. Therefore, if the log strike force L is the same in both instances, and dimensions X1 and X2 are also equal, the present invention in FIG. 7B will be able to withstand a greater force without failure than the prior art system shown in FIG. 7A. This improved robustness is the result of the greater magnitude of dimension R2 compared with dimension R1.

Figure 8A:
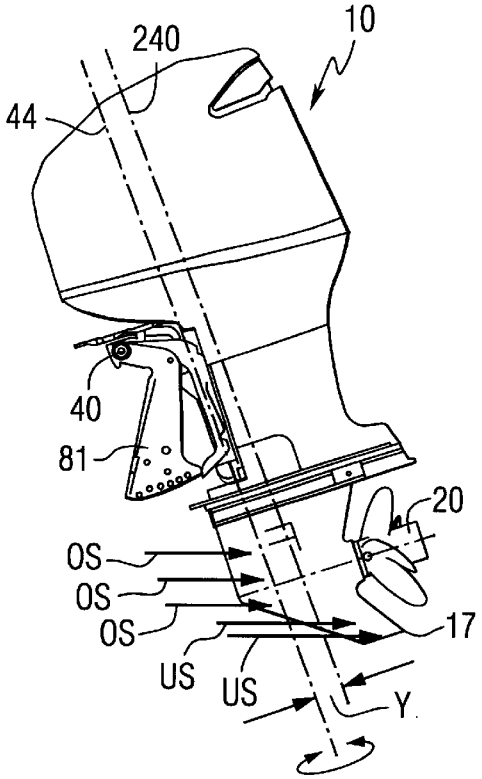
FIG. 8A PRIOR ART
FIGS. 8A and 8B compare the prior art to the present invention with regard to certain steering instabilities caused by water passing in contact with the lower gearcase of the outboard motor.
Figure 8B:
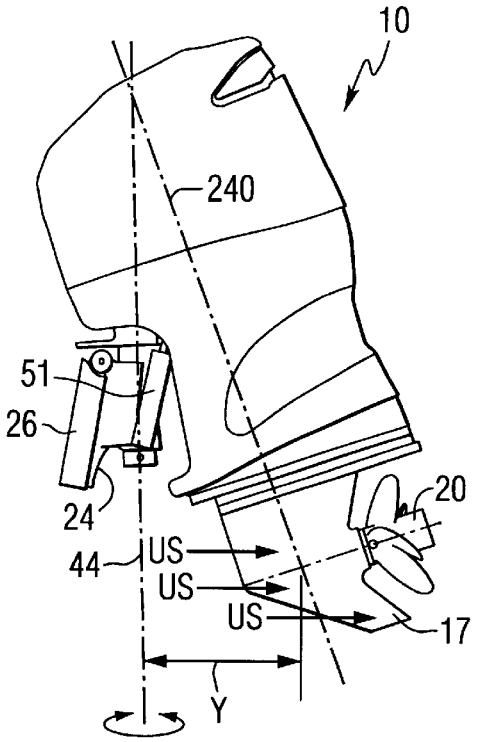

FIGS. 8A and 8B show a prior art arrangement and the present invention, respectively, under a condition in which the forces of the water on the lower gearcase can affect steering. In FIGS. 8A and 8B, the steering axis 44 is illustrated in combination with an axis 240 that identifies the line along which the driveshaft extends. Axis 240 is provided to illustrate the relative positions of the steering axis 44 and axis 240 under various conditions. Both outboard motors, in FIGS. 8A and 8B, are shown with a similar degree of trim. The steering axis 44 of the present invention in FIG. 8B remains generally vertical and stationary relative to the transom of the boat. However, the steering axis 44 in the prior art shown in FIG. 8A remains generally parallel with axis 240 and tilts in response to the outboard motor 10 being trimmed about the tilting axis 40.

With reference to FIGS. 8A and 8B, the horizontal arrows represent the force vectors of water exerted against the lower gearcase and skeg 17. When the operator of a watercraft is steering the boat to either port or starboard, these force vectors affect the effort required by the operator. The three arrows identified as OS is FIG. 8A exert a force on the lower gearcase that tends to move the outboard motor 10 toward an oversteering condition. The two lower arrows US tend to force the outboard motor 10 toward an understeering condition. The effect of these force vectors depends on the contact location on the lower gearcase of the water's force. Any force exerted to the left of the steering axis 44 in FIG. 8A will result in an oversteering condition while any force exerted to the right of the steering axis 44 in FIG. 8A will result in an understeering condition. In comparison, the steering axis 44 of the present invention shown in FIG. 8B is always to the left of axis 240. The entire lower gearcase and skeg 17 are located aft of the steering axis 44 under all conditions. Therefore, any forces exerted by the water on the lower gearcase will be consistently in an understeering direction. This consistency provides improved stability during steering operations.

Figure 9A:
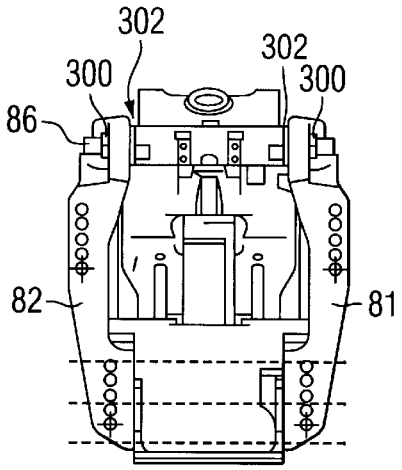
FIG. 9A PRIOR ART
FIGS. 9A and 9B compare the prior art to the present invention with regard to the robustness and integrity of the mounting plates used to attach an outboard motor to a transom.
Figure 9B:
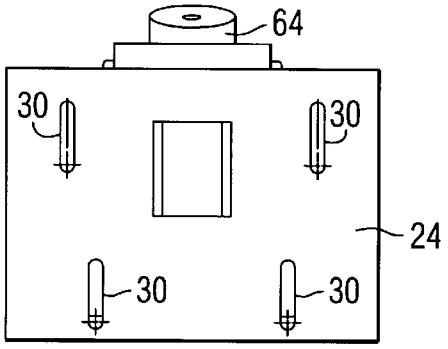

FIGS. 9A and 9B show the prior art support structure in the present invention, respectively, when viewed from the transom of a boat facing the front of the structure. It should be noted that the starboard clamp bracket 82 and the port clamp bracket 81 are two separate components. In addition, the two clamp brackets, 81 and 82, are held together by several components in combination with washers and spacers. For example, the swivel tube 86 is held in position by bolts 300 in combination with washers disposed at the locations identified by reference numeral 302. As a result, the several individual components illustrated in FIG. 9A are slightly moveable relative to each other. As a result, the port and starboard clamp brackets, 81 and 82, do not always lie flat with their planer surfaces firmly against the transom of a boat. Relative movement of these components can result in wear and loosening of the fasteners used to hold the structure together. Unlike the structure in FIG. 9A, the present invention illustrated in FIG. 9B has a single plate in contact with the transom. This plate can be the pedestal 24 or, as described above, can be the intermediate plate 26 when the intermediate plate is used. It should be understood that, although the elongated openings 30 are shown as simplified slots in FIG. 9B, they can comprise a plurality of similarly shaped portions 34. The precise structure of these fastening devices will be described below in greater detail.

Figure 10A:
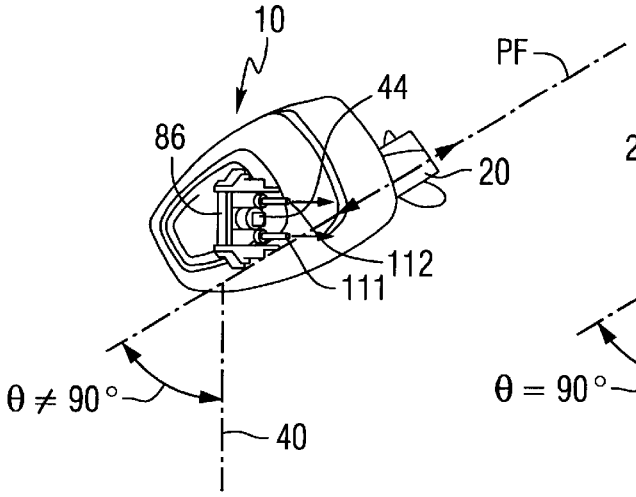
FIG. 10A PRIOR ART
FIGS. 10A and 10B compare the prior art to the present invention with regard to the thrust vector of a propeller in association with the tilt axis.
Figure 10B:
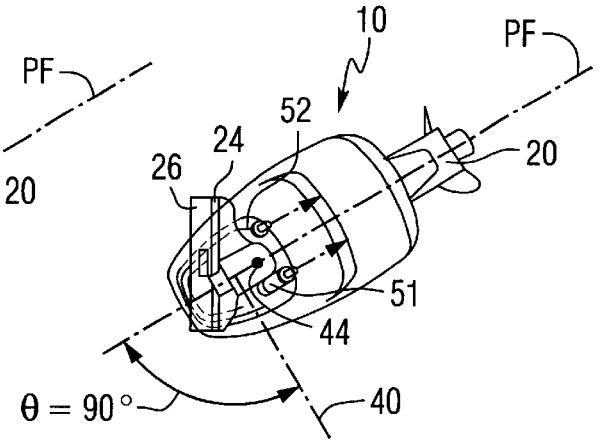

FIGS. 10A and 10B illustrate another advantage of the present invention. The prior art arrangement in FIG. 10A shows that the force of the propeller 20 on the outboard motor and its supports is not aligned with the tilt axis 40. The axis PF along which the propeller 20 exerts a force on the structure is not perpendicular to the tilt axis in the region of the support structure that is attached to the transom. As a result, a twisting force is exerted on the overall structure whenever the operator steers the boat in a direction other than straight ahead. In clear contradistinction to the arrangement shown in FIG. 10A, the present invention shown in FIG. 10B always causes the propeller force, exerted along axis PF, to remain perpendicular to the tilt axis 40. This reduces twisting and distortion in the overall assembly that comprises the outboard motor 10, the pedestal 24, and the intermediate plate 26.

Figure 11A:
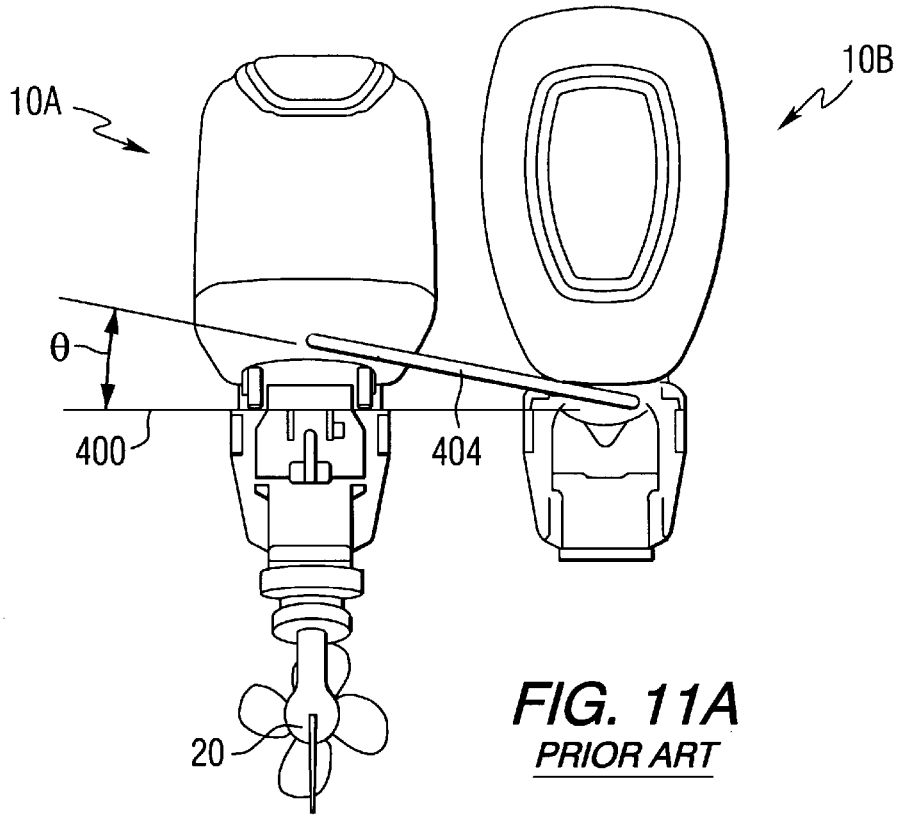
FIG. 11A PRIOR ART
FIGS. 11A and 11B compare the prior art to the present invention with regard to the use of tamdem outboard motors on a single transom.
Figure 11B:
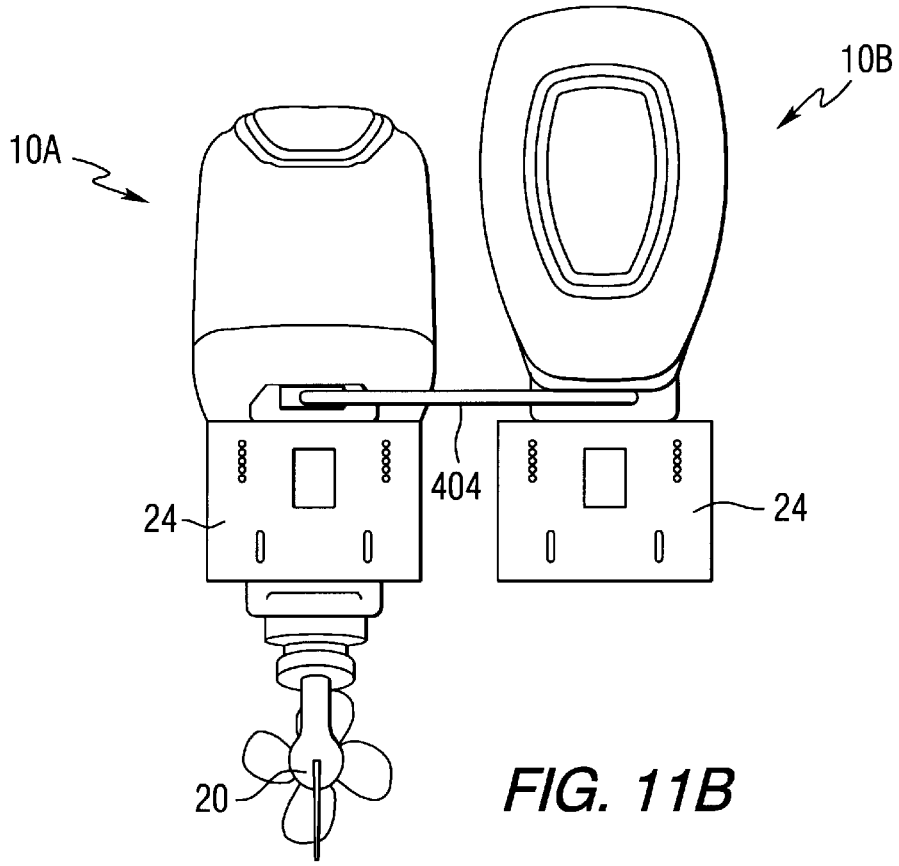

FIGS. 11A and 11B show tandem outboard motor arrangements incorporating the concepts of the prior art and the present invention, respectively. In FIG. 11A, two outboard motors 10A and 10B are attached to a common transom. Line 400 represents a horizontal line that is generally coincident with the upper edge of a transom. Outboard motor 10A is in its normal operating position with the propeller 20 submerged under the surface of the water behind the boat. Outboard motor 10B, on the other hand, is tilted up to its maximum tilt angle. Normally, when two outboard motors are used in tandem on a common transom of a boat, a rigid connecting bar 404 is attached to both steering yokes so that the two outboard motors can be steering in coordinating fashion. However, when the outboard motor 10B is tilted up as shown in FIG. 11A, while outboard motor 10A is in its normal operating position, the rigid steering bar 404 is forced into the position shown in FIG. 11A which defines an angle θ. Even though outboard motor 10B is not being used, it moves in coordination with outboard motor 10A as the operator steers the boat. This distorted position of the bar 404 shown in FIG. 11A requires other components, such as the steering cables and steering mechanisms, to appropriately account for the unnatural position of the bar 404.

The present invention shown in FIG. 11B, does not exhibit this same problem described above in conjunction with FIG. 11A. As shown, outboard motor 10A is in its normal operating position with a propeller 20 extending downward into the water behind the transom of a boat. Outboard motor 10B, on the other hand, is tilted upward at its maximum position. Because the steering axis is unaffected by the tilting of the outboard motor in the present invention, the rigid bar 404 does not move when outboard motor 10B is tilted upward as shown. Although not illustrated in FIGS. 10A and 10B, it should also be understood that when turning toward port or starboard, the outboard motors 10A and 10B, of the present invention remain generally aligned in a parallel configuration with each other throughout virtually the entire range of steering. This occurs because both outboard motors are being rotated about generally vertical and stationary steering axes. The prior art, on the other hand, causes the outboard motors to rotate about non vertical steering axes when the outboard motor 10B is tilted upward. As a result, the two steering axes for the two outboard motors, 10A and 10B, in FIG. 11A are not parallel to each other. As a result, rotation of the two outboard motors about their respective steering axes will cause the outboard motors to rotate in a nonparallel association and possibly move into contact with each other after a minimal amount of rotation about their respective steering axes.

Figure 12:
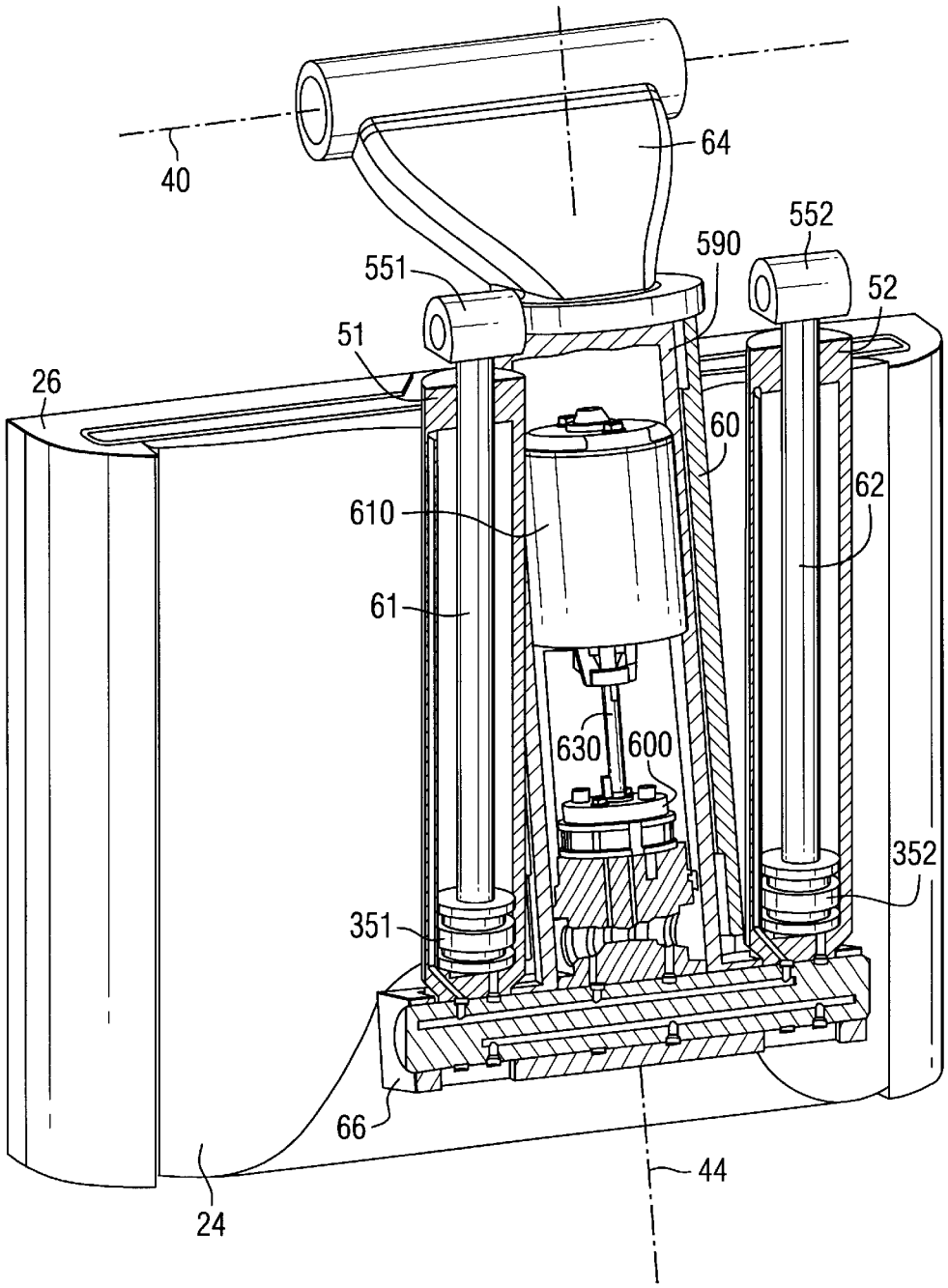
FIG. 12 shows an embodiment of the present invention in which a hydraulic pump and an electric motor are housed within the steering mechanism.

FIG. 12 shows another feature of the present invention that is significantly beneficial to the operation of the outboard motor. The pedestal 24 is shown attached to the intermediate plate 26. The hydraulic cylinders, 51 and 52, are shown in section view to illustrate internal components. Pistons, 351 and 352, are disposed within the cylinders, 51 and 52, and the rods, 61 and 62, are attached to is the pistons. Rod eyes 551 and 552 are attached to the rods to facilitate the attachment of the rods to the outboard motor. Steering head 64 is connected to the swivel tube 590 which, in turn, is connected to the lower yoke 66. This forms a rotatable unit that comprises the steering head 64, the swivel tube 590, and the lower yoke 66. Together, these components provide the motor support platform to which the outboard motor is attached. As illustrated in FIG. 12, the swivel tube 590 is disposed within the pedestal tube 60 and is rotatable therein.

The present invention takes advantage of the structure of the steering mechanism by disposing the hydraulic pump 600 within the hollow interior of the swivel tube 590. A motor 610 is also disposed within the swivel tube 590 and is connected to the hydraulic pump 600 by shaft 630 so that the electric motor 610 can drive the hydraulic pump 600 and provide pressurized hydraulic fluid to actuate the hydraulic cylinders, 51 an 52. In comparison, it should be understood that the prior art structure shown in FIG. 4 typically includes the electric motor and hydraulic in the space between cylinder 121 and bracket 82. In addition, a fluid reservoir is typically located in the region between cylinder 121 and bracket 81 in FIG. 4. In comparison, the inclusion of the electric motor 610 and hydraulic pump 600 within the internal cavity of the swivel tube 590 saves valuable space and also protects these components from the environment.

In FIG. 12, it can be seen that the electric motor 610, the shaft 630, and the hydraulic pump 600 are all stored within the swivel tube 590 in line with the steering axis 44. Within the lower yoke 66, fluid passages are provided to connect the hydraulic pump 600 in fluid communication with the spaces within cylinders 51 and 52 above and below the pistons, 351 and 352. These passages can be seen in the section view taken through the lower yoke 66. As the operator of a boat steers the boat, the pedestal tube 60 remains stationary and fixed to the pedestal 24. The internal swivel tube 590 rotates with the steering head 64 and the lower yoke 66. The electric motor 610 and the hydraulic pump 600 rotate, along with their respective fluid passages, with the lower yoke 66 and the two cylinders, 51 and 52.

Figure 13:
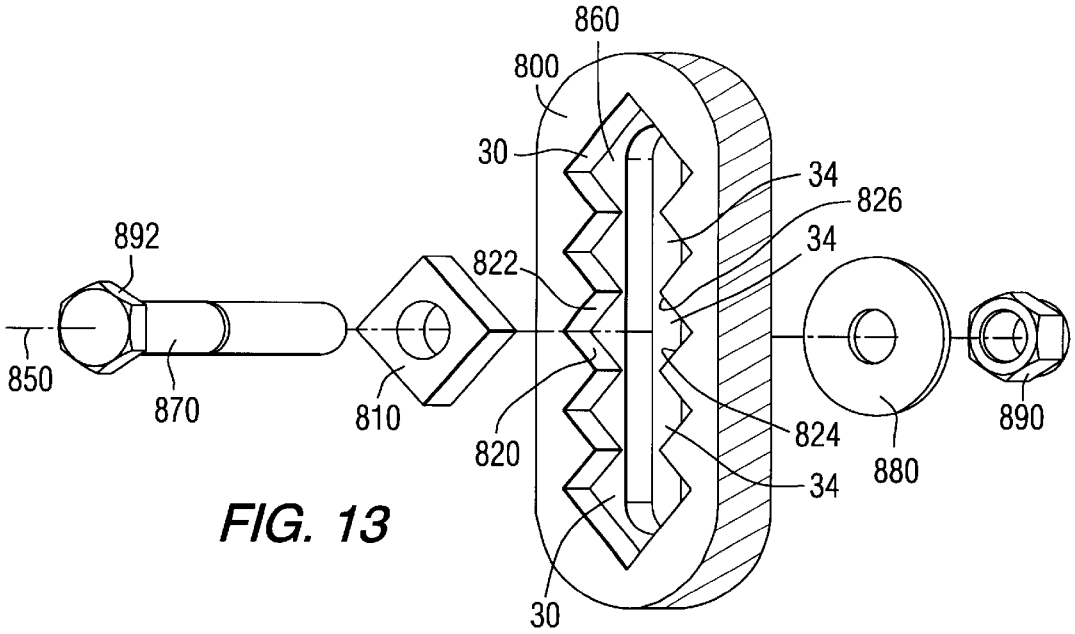
FIG. 13 is an exploded view of a fastener made in accordance with the present invention.

FIG. 13 shows a fastener that is used in conjunction with the other components of the present invention to simplify the process of accurately and rigidly attaching an outboard motor to the transom of a boat. With reference to FIG. 4, it can be seen that the prior art brackets, 81 and 82, use a plurality of individual holes 700 that can be individually aligned with holes in the transom of a boat. After the alignment is complete, a bolt is extended through hole 700 and through a similarly sized hole in the transom. A washer and nut is then used to rigidly attach the transom brackets, 81 and 82, to the transom of a boat. This procedure of attaching the transom brackets to the transom of a boat can be cumbersome and difficult. In addition, moving the transom brackets from one position to another position requires the associated bolt to be completely removed from both the transom bracket and the transom and then reinserted into another of the transom bracket and the hole through the transom itself. The present invention provides a simplified and more efficient procedure to accomplish the attachment of either the pedestal 24 or the intermediate plate 26 to the transom of a boat.

The component in FIG. 13 identified by reference numeral 800 represents a section of a first component, such as the pedestal 24 or intermediate plate 26 described above in conjunction with FIG. 2. An elongated opening 30 comprises a plurality of similarly shaped portions 34. In FIG. 13, the similarly shaped portions 34 are generally diamond-shaped but other shapes could also be used. These similarly shaped portions 34 define five unique positions within the elongated opening 30.

An insert 810, which resembles a square washer, is shaped to be received in any one of the similarly shaped portions 34. The four surfaces, 820, 822, 824, and 826 of each similarly shaped portions 34 defines a square shape that is similar to the outer surfaces of the insert 810. This allows the insert 810 to be inserted into any one of the similarly shaped portions 34 by simply moving the insert 810 perpendicularly away from the plane of the elongated opening. In other words, if the insert 810 is moved along axis 850 toward the left in FIG. 13, it becomes free from the restrictions provided by surfaces 820, 822, 824, and 826. These surfaces limit the movement of the insert within the elongated opening to a direction perpendicular to the plane of the elongated opening. This plane is parallel to surface 860 in FIG. 13. When used to fasten a first component, such as the structure 800 that represents a portion of the pedestal 24 or the intermediate plate 26, to a second component, such as a transom, a hole is formed in the second component. The cylindrical member 870, which can be a bolt, is disposed through the insert 810, through the hole in the second component, and through the elongated opening 30 of the fastener. A capture mechanism such as the washer 880 and nut 890, prevents the insert 810 from moving out of the elongated opening 30 in a direction perpendicular to the plane of the elongated opening 30. The insert 810 is held in place in one of the plurality of similarly shaped portions 34 by the head 892 of the bolt and the washer 880 in combination with the nut 890.

Figure 14:
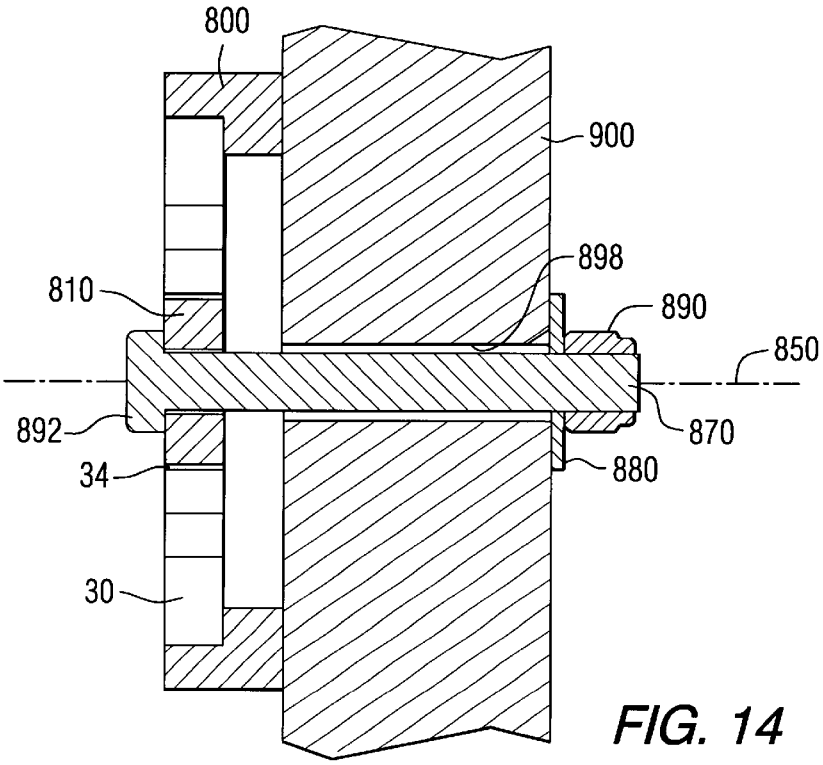
FIG. 14 is an assembled section view of the components illustrated in FIG. 13 in combination with a transom of a boat.

FIG. 14 is a section view showing the cylindrical member 870 extending through the insert 810 and the hole 898 formed in the transom 900. The washer 880 and nut 890 cooperate with the head 892 of the bolt, or cylindrical member 870, to retain the insert 810 within a particular one of the plurality of similarly shaped portions 34 within the elongated opening 30. This structure rigidly attaches the first component 800 to the second component 900. In addition, if it is desired to move the insert 810 from one of the plurality of similarly shaped portions 34 to another one of the plurality of similarly shaped portions 34, the procedure is relatively simple in comparison to methods currently used to readjust outboard motors. The nut 890 is loosened sufficiently to allow the inset 810 to be moved toward the left in FIG. 14, along axis 850 until it is out of its associated one of the plurality of similarly shaped portions 34. When this occurs, the first component 800, such as the pedestal 24 of the present invention, can be moved relative to the second component 900, or transom, until the insert 810 is aligned with another one of the plurality of similarly shaped portions 34. The insert 810 can then be inserted into the elongated opening 30 and into its particular one of the plurality of similarly shaped portions 34. When this occurs, the cylindrical member 870 can again be used to retain and capture the insert 810 with the cooperation of the washer 880 and the nut 890.

Figure 15:
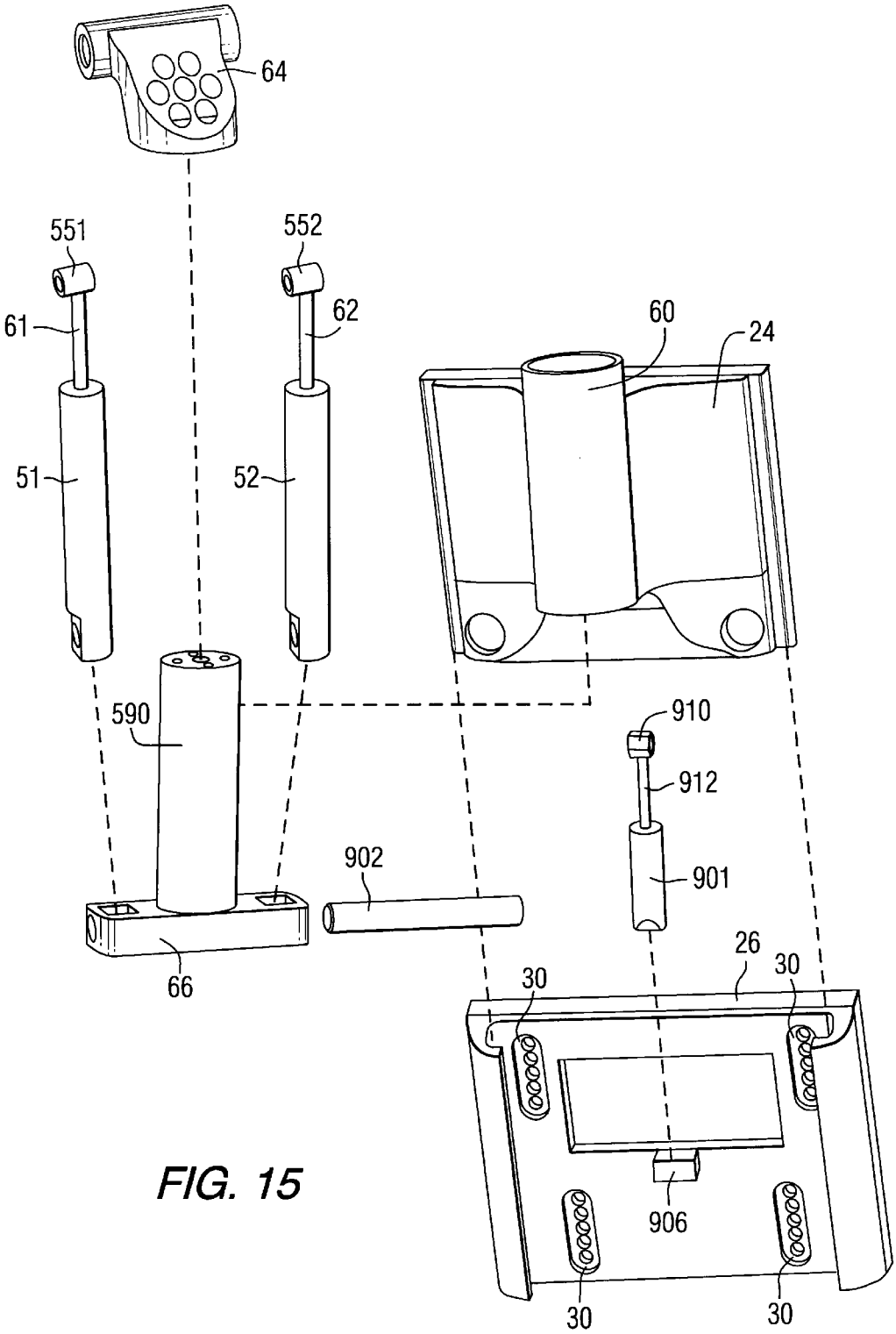
FIG. 15 is an exploded view of the intermediate plate and pedestal of the present invention with its constituent parts.
Figure 16:
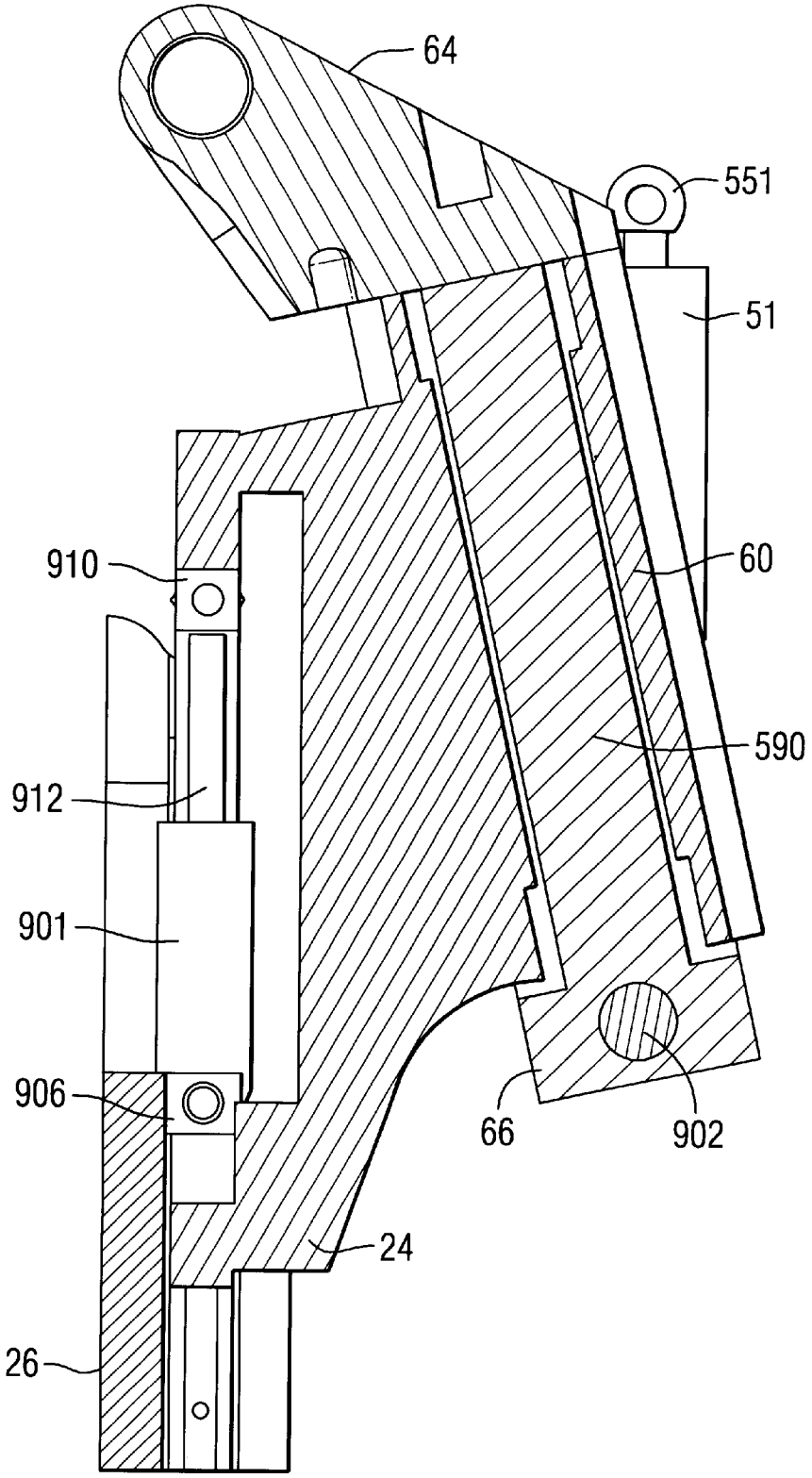
FIG. 16 is a section view taken through the intermediate plate and pedestal of the present invention.

FIGS. 15 and 16 are two views of the present invention that more clearly illustrate an additional feature that allows a jacking cylinder 900 to be used to assist in moving the pedestal 24 relative to the intermediate plate 26. The exploded view of FIG. 15 shows the individual components, the lower yoke 66 is attached to the bottoms of the two cylinders, 51 and 52, by rod 902 which extends through a hole formed in the lower yoke 66. The swivel tube 590 is inserted in the pedestal tube 60 and the steering head 64 is attached to the upper end of the swivel tube 590. The jacking cylinder 900 is attached to a pad 906 of the intermediate plate 26 and the distal end 910 of the rod 912 is attached to the pedestal 24. By providing hydraulic fluid under pressure to the cylinder 900, the rod 912 can be forced upward to raise the pedestal 24 relative to the intermediate plate 26 that is attached to the pedestal. The use of hydraulic power significantly simplifies the movement of the pedestal 24 and its outboard motor relative to the intermediate plate 26 that is rigidly attached to the transom of a boat.

With continued reference to FIGS. 15 and 16, the attachment of the intermediate plate 26 is facilitated by the elongated slots 30 formed through the intermediate plate 26, some of which are simple slots and others are provided with individual holes through the intermediate plate 26. It can be seen that the attachment of the intermediate plate 26 in FIG. 15 is not shown as utilizing the advantageous shape of the present invention as described above in conjunction with FIGS. 13 and 14. However, it should be realized that the elongated slots 30 shown in FIG. 15 could utilize the present invention described above. It should also be realized that the two upper elongated slots 30 in FIG. 15 are provided with individual holes therethrough while the two lower elongated slots in FIG. 15 are simple slots. This choice of positioning is not limiting to the present invention and the embodiment of the present invention shown in FIGS. 13 and 14 could advantageously be used in place of the elongated slots illustrated in FIG. 15.

In FIG. 16, it can be seen that the extension of the rod 912 from the cylinder 900, in response to the flow of pressurized hydraulic fluid into the cylinder 900, can move the pedestal 24 upward in FIG. 16 relative to a stationary intermediate plate 26.

Several features of the present invention have been described in detail above and illustrated to show a particularly preferred embodiment. One embodiment comprises a pedestal 24 which is attachable either to a transom of a boat or to an intermediate plate 26. A motor support platform which comprises a steering head 64, a lower yoke 66, and a swivel tube 590 is attached to an outboard motor. A steering mechanism, which comprises the pedestal tube 60 and the swivel tube 590 is attached to both the pedestal 24 and the motor support platform. A tilting mechanism, which comprises one or more hydraulic cylinders, 51 and 52, is attached to the motor support platform and to the outboard motor. The outboard motor is rotatable about a tilting axis 40 relative to both the pedestal 24 and the motor support platform which comprises the lower yoke 66 and the steering head 64. The tilting mechanism itself is rotatable relative to the pedestal 24 and about a steering axis 44. The steering axis 44 is generally vertical and stationary relative to the pedestal 24 while the tubing mechanism, such as the hydraulic cylinders, 51 and 52, is rotatable relative to the pedestal 24 and rotatable about the steering axis 44 with the outboard motor 10.

Another embodiment of the present invention was described in conjunction with FIG. 12 in which a pedestal 24 is attached to a transom of a boat and a motor support platform, comprising the lower yoke 66 and the steering head 64 in cooperation with the swivel tube 590, is attached to the outboard motor. The steering mechanism, which comprises the pedestal tube 60 and the swivel tube 590, is attached to both the pedestal 24 and the motor support platform. A hydraulic tilting mechanism, which comprises the two cylinders, 51 and 52, is attached to the motor support platform and to the outboard motor. A hydraulic pump 600 is connected in fluid communication with the hydraulic tilting mechanism and provides pressurized fluid to cause the outboard motor to rotate about its tilting axis 40 when the pistons, 351 and 352, are moved within their respective cylinders. An electric motor 610 is used to drive the hydraulic pump. Both the electric motor 610 and the hydraulic pump 600 are disposed within the steering mechanism. More specifically, they are disposed within the swivel tube 590 which, in turn, are disposed within the pedestal tube 60. Another embodiment of the present invention was described in conjunction with FIGS. 13 and 14, in which a first component 800 is attached to a second component 900. The first component can be the pedestal 24 and the second component can be the transom of the boat. An elongated opening 30 is formed in the first component 800 and comprises a plurality of similarly shaped portions 34. An insert 810 is disposable into each and every one of the plurality of shaped portions and, when so inserted, the insert 810 is limited in movement by the elongated opening to a single direction which is perpendicular to the plane of the elongated opening. A hole 898 is formed in the second component 900 and a cylindrical member 870 is disposable through the insert 810, through the hole 898, and through the elongated opening 30. A capture mechanism, which can comprise a washer 880 and a nut 890, prevents the insert 810 from moving out of the elongated opening 30 in a direction perpendicular to the plane of the elongated opening 30.

Although the present invention has been described with particular detail and illustrated with specificity to show several preferred embodiments of the present invention, it should be understood that other embodiments are also within its scope.

What is claimed is:

1. A marine propulsion system which is attachable to a transom of a marine vessel, said system comprising:

an elongated opening formed in a plate of said marine propulsion system, said elongated opening having a plurality of similarly shaped portions aligned along a generally straight line;

an insert which is disposable into each one of said plurality of similarly shaped portions, each of said plurality of similarly shaped portions of said elongated opening being of a shape similar to said insert and shaped to receive said insert therein, said insert being limited in movement by said elongated opening to a direction perpendicular to the plane of said elongated opening;

a cylindrical member disposable through said insert, through a hole formed in said transom, and through said elongated opening, said elongated opening being sized to permit said cylindrical member to move freely between individual ones of said plurality of similarly shaped portions when said insert is disposed outside of said elongated opening; and a capture mechanism which prevents said insert from moving out of said elongated opening in said direction perpendicular to said plane of said elongated opening.

2. The fastener of claim 1, wherein:

each of said plurality of similarly shaped portions of said elongated opening comprises four generally planar surfaces that define a four-sided shape within said plane of said elongated opening.

3. The fastener of claim 2, wherein:

said four-sided shape is a square.

4. The fastener of claim 1, wherein:

said cylindrical member is a bolt.

5. The fastener of claim 4, wherein:

said capture mechanism comprises a head of said bolt, a washer, and a nut threaded onto an end of said bolt opposite to said head.

6. The fastener of claim 5, wherein:

said washer is disposed between said nut and said second component.

7. A marine propulsion system which is attachable to a transom of a marine vessel, said system comprising:

an elongated opening formed in a pedestal plate of said marine propulsion system, said elongated opening having a plurality of similarly shaped portions;

an insert which is disposable into each one of said plurality of similarly shaped portions, each of said plurality of similarly shaped portions of said elongated opening being of a shape geometrically similar to said insert and shaped to receive said insert therein, said insert being limited in movement by said elongated opening to a direction perpendicular to the plane of said transom;

a cylindrical member disposable through said insert, through a hole formed in said transom, and through said elongated opening, said insert being shaped to receive said cylindrical member in sliding relation therein, said elongated opening being sized to permit said cylindrical member to move freely between individual ones of said plurality of similarly shaped portions when said insert is disposed outside of said elongated opening; and a capture mechanism which prevents said insert from moving out of said elongated opening in said direction perpendicular to said plane of said transom.

8. The fastener of claim 7, wherein:

each of said plurality of similarly shaped portions of said elongated opening comprises four generally planar surfaces that define a square shape within said plane of said elongated opening.

9. The fastener of claim 8, wherein:

said cylindrical member is a bolt;

said capture mechanism comprises a head of said bolt, a washer, and a nut threaded onto an end of said bolt opposite to said head; and said washer is disposed between said nut and said transom.

* * * * *